US009974333B1

(12) United States Patent
Disner

(10) Patent No.: US 9,974,333 B1
(45) Date of Patent: May 22, 2018

(54) DEVICE AND METHOD FOR VAPORIZING A SUBSTANCE

(71) Applicant: Daniel John Disner, Trinidad, CO (US)

(72) Inventor: Daniel John Disner, Trinidad, CO (US)

( * ) Notice: Subject to any disclaimer, the term of this patent is extended or adjusted under 35 U.S.C. 154(b) by 0 days. days.

(21) Appl. No.: 15/411,978

(22) Filed: Jan. 21, 2017

(51) Int. Cl.
*A24F 47/00* (2006.01)

(52) U.S. Cl.
CPC ..... *A24F 47/006* (2013.01)

(58) Field of Classification Search
None
See application file for complete search history.

(56) References Cited

U.S. PATENT DOCUMENTS 4,846,199 A * 7/1989 Rose ..... A24B 15/165 131/198.2
5,574,052 A * 11/1996 Rose ..... A24B 15/16 131/270
5,944,025 A * 8/1999 Cook ..... A24F 47/006 131/194
6,178,969 B1 * 1/2001 St. Charles ..... A24F 47/002 131/273
8,424,537 B2 * 4/2013 Rosenthal ..... A61M 11/041 131/191
9,155,848 B2 * 10/2015 Emarlou ..... A61M 11/041
9,474,304 B2 * 10/2016 Born ..... A24F 1/28
2002/0074006 A1 * 6/2002 Gunn ..... A24F 1/30 131/173

* cited by examiner

*Primary Examiner* — Tho D Ta

(57) ABSTRACT

A simple vaporizing device with four concentric tubes and a wire mesh wick for volatizing, by vaporization, and inhaling one or more constituents of various vaporizable substances. The device is operated using the flame from a standard butane cigarette lighter or other flame producing devises as the sole heat source, and the user's inhalation process for air flow. Concentric tubes, an inner tube with two open ends to provide a direct pathway for the flow of air and vapor; and outer tubes with open ends, one moveable, are arranged to provide for the application, vaporization, and delivery of the vaporizable substance as a single dose.

11 Claims, 2 Drawing Sheets

FIG. 1
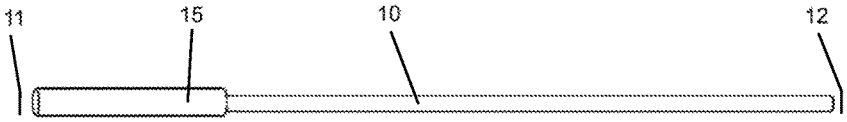
FIG. 2
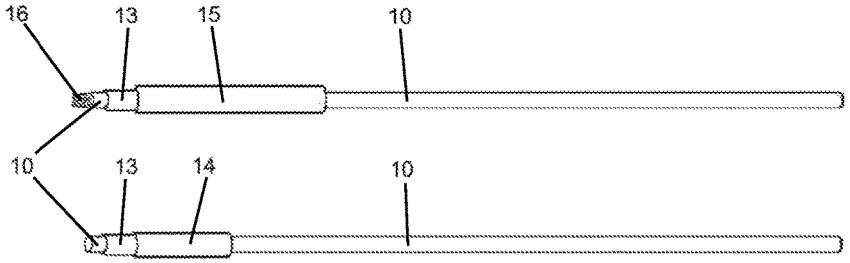
FIG. 3
FIG. 4
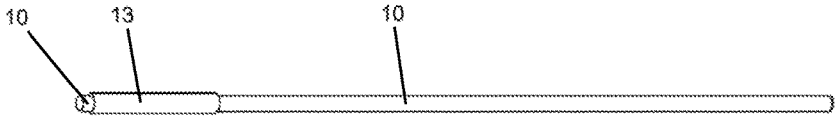
FIG. 5
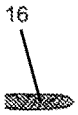
FIG. 6
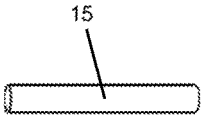
FIG. 7
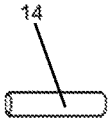
FIG. 8
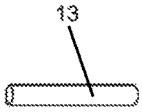
FIG. 9
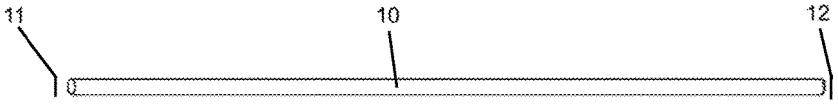

DEVICE AND METHOD FOR VAPORIZING A SUBSTANCE

REFERENCES TO RELATED PATENTS

U.S. Pat. No. 9,474,304 Born and Davis Oct. 25, 2016
U.S. Pat. No. 8,424,537 Rosenthal April 23, 2-13
U.S. Pat. No. 9,155,848 Emarlou Oct. 13, 2015

REFERENCES TO OTHER MATERIALS https://www.wired.com/2016/02/exploding-e-cigs-and-vape-pens/—exploding battery
https://youtu.be/xS8LsPv1_uM—battery failure: fire

BACKGROUND OF THE INVENTION

This invention relates to the field of heat vaporization of various substances, such as plant extracts and medicines to produce vapors for inhalation.

All other devices identified through market and patent search, and intended for facilitating the volatizing and inhaling of the constituents of various vaporizable substances (substance[s]), such as medicines and plant materials, and commonly referred to as, among other, 'vaporizers', 'dab tubes', 'dab pipes', 'dab pens', and 'nectar collectors', rely on, 1) electronic elements to heat and vaporize the substance or, 2) application of a flame to a heating surface or element so as to bar contact of the flame with the substance and, 3) the use of a separate utensil for the application of the substance to the device. Further, they do not provide an adequate process by which the user can effectively control dosage. The design of these devices is intended to produce a vapor from a substance without the possibility of combustion of the substance. The desire of other devices to completely eliminate combustion in the vaporization process necessitates the use of complex designs, often incorporating electronic systems, which complicate the manufacturing process and user experience, and provide numerous opportunities for device failure (i.e. see: https://www.wired.com/2016/02/exploding-e-cigs-and-vape-pens/, https://youtu.be/xS8LsPv1_uM)

BRIEF SUMMARY OF THE INVENTION

This invention, the Flash Dab, employs, 1) the use of a flame, avoiding failure caused by electrical malfunction (including the possibility of explosion or fire), 2) a simple design providing for a direct line of air and vapor flow from distal to proximal end and, 3) incorporating use of the vaporizing wick as application utensil. Further, the design and function of the wick as application utensil provides the user with the ability to easily control dosage.

The function of the wick, and its placement within this device, is to limit contact between the substance and the applied flame limiting, while not necessarily eliminating, the amount of combustion taking place in the vaporization process. The specific placement of the wick within the device is such that the tip of the wick protrudes beyond the intake end of the barrel where it, and the portion of substance contained therein, is exposed to direct flame. The remainder of the wick, and the portion of substance contained therein, is located within the barrel where it is heated by way of conduction through the metal mesh and the passage of hot gasses and vapors from the heating chamber. The design of the heating chamber is such as to allow only the oxygen-depleted gasses of the flame to enter, thereby limiting or eliminating combustion of the substance as those hot gasses pass through the wick.

BRIEF DESCRIPTION OF THE SEVERAL DRAWINGS

All drawings represent the prototype of the current invention for a finished length of 5.25 inches.

FIG. 6-9 show components of the invention, all comprising round brass tubing with wall thickness of 0.014 inch FIG. 1 shows the finished device with the hood in the closed position.

FIG. 2 shows the finished device with the hood in the open position.

FIG. 3 shows the device stem with both sleeves crimped in position over the long inner tube.

FIG. 4 shows the device stem partially assembled with the inner sleeve in position over the stem.

FIG. 5 shows the wick, comprised of 80-mesh brass screen tightly rolled and crimped at distal end.

FIG. 6 shows the hood component comprising 1.5 inches of round brass tubing of 7/32" diameter.

FIG. 7 shows the outer of 2 sleeves comprising 0.75 inch of round brass tubing of 3/16" diameter.

FIG. 8 shows the inner of 2 sleeves comprising 1 inch of round brass tubing of 5/32" diameter.

FIG. 9 shows the long inner tube comprising 5 inches of round brass tubing of 1/8" diameter.

DETAILED DESCRIPTION OF THE INVENTION

Figure 10:
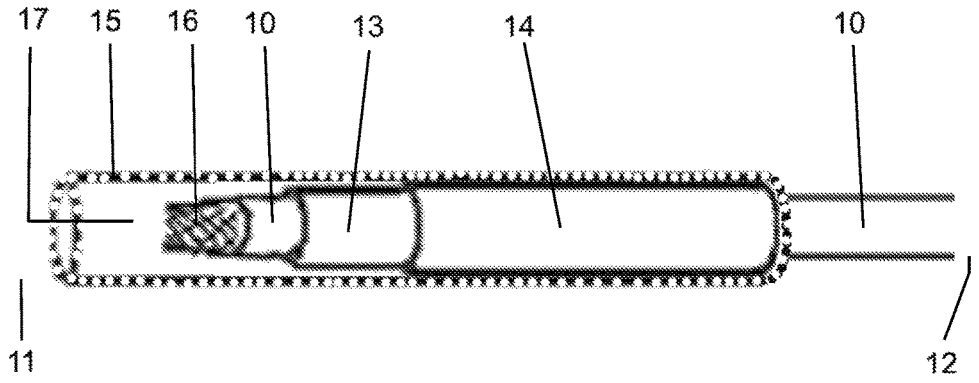
FIG. 10 shows an exploded view of the distal end of the device as represented in FIG. 1, where the various components form the heating chamber of the device.

The prototype device is 5.25 inches in length. Variations in length and other dimensions are anticipated. The specifications of the materials used in the prototype are listed in the preceding section entitled 'BRIEF DESCRIPTION OF THE SEVERAL DRAWINGS'.

The device comprises 5 components: one long hollow metal tube (10); one first short hollow metal tube (13) positioned concentrically around the long tube (10) and crimped permanently in place; one second short hollow metal tube (14), slightly shorter than first tube (13), positioned concentrically around the first (13) and crimped permanently in place to comprise the stem (FIG. 3); one wick (16) comprised of tightly rolled fine wire metal mesh, crimped at one end, that is inserted into the stem at the distal end leaving approximately ⅓ of its length, crimped end, exposed and ⅔ within the long stem component tube (10); one short hollow metal tube (15) positioned concentrically around the stem (FIG. 3) so as to enclose the two short tubes and wick at the distal end of the stem, forming a heating chamber (FIG. 10), and attached in a manner so as to allow it to slide back and forth over the distal end of the device without detaching from the device.

In use, the hood (15) is slid back toward the proximal end (12), exposing the wick (16) and tips of the sleeves (13, 14) so that a substance can be applied to the wick (FIG. 2). In the case of a substance with a wax-like consistency, the wick is heated so as to melt and draw the substance into the wick. The substance is applied to the wick by putting the wick in direct contact with the substance. The hood is then slid forward to encase the distal end of the device including the wick and tips of the sleeves (FIG. 1) to form the heating chamber (FIG. 10). A flame is applied to the distal end of the device (11) and the user sucks on the proximal end (12) to draw the flame and hot gasses of the flame into the heating chamber (FIG. 10) and through the wick, where the substance is vaporized with minimum or no combustion, and drawn through the stem (FIG. 3) and into the mouth of the user, followed by inhalation.

The invention claimed is:

1. A device for vaporizing and inhaling constituents of a vaporizable plant substance in a single dose, comprising:

a stem with an open proximal end and an open distal end, said stem comprised of a first short hollow tube and a second short hollow tube as sleeves, said sleeves positioned and crimped in place around a long inner tube near the open distal end;

a wire mesh wick inserted into the long inner tube at the open distal end of the stem, said wire mesh wick for the application, retention and heating of the vaporizable plant substance; and a third short hollow tube positioned concentrically around the stem to form a hood over the first short hollow tube, the second short hollow tube and the wire mesh wick, said hood sized and crimped so as to be slidable back toward the open proximate end of the stem to expose the open distal end, and slidable forward to enclose the open distal end, without detaching from the stem.

2. The device of claim 1, wherein one or more of said tubes comprising said device are formed of a metal including at least one of brass and silver.

3. The device of claim 1, wherein at least one tube of said tubes comprising said device is of an inner diameter (ID) and an outer diameter (OD), that allows the at least one tube to slide with minimal clearance over at least one other tube of said tubes.

4. The device of claim 1, wherein said hood is slidable back toward the open proximal end to expose the wire mesh wick for the purpose of applying the vaporizable plant substance to the wire mesh wick.

5. The device of claim 1, wherein said hood is slidable forward over the open distal end to enclose the wire mesh wick and form an open ended chamber to which heat can be applied to vaporize the vaporizable plant substance.

6. The device of claim 1, wherein said hood, in a forward position, protects the wire mesh wick from damage when said device is not in use.

7. A method of volatizing and inhaling a substance comprising:

applying the substance to a wire mesh wick inserted into a long inner tube at an open distal end of a device;

applying heat to a heating chamber at the open distal end of said device, said heating chamber comprised of the wire mesh wick enclosed by a hood, said hood comprised of an outer hollow tube concentrically positioned around the long inner tube and at least one short inner hollow tube at the open distal end of said device, said hood sized and crimped so as to be slidable forward to enclose the wire mesh wick at the open distal end of said device;

reducing the air pressure at an open proximal end of said device in response to a user's inhalation process; and drawing a flame and hot gasses of the flame into the heating chamber, wherein said heat is conducted through the wire mesh wick thereby vaporizing the substance, and wherein the drawn hot gasses pass from the open distal end, through the wire mesh wick, through the long inner tube, and to the open proximal end of the device.

8. The method of claim 7, wherein said heat is comprised of the flame and hot gasses of the flame emanating from a flame producing device.

9. The device of claim 1, wherein the constituents of the vaporizable plant substance comprises at least one extract.

10. The device of claim 1, where the at least one extract comprises at least one of a wax and an oil.

11. The method of claim 8, wherein the flame producing device is a butane cigarette lighter.

* * * * *